US006700540B2

(12) United States Patent
Holshouser

(10) Patent No.: US 6,700,540 B2
(45) Date of Patent: Mar. 2, 2004

(54) ANTENNAS HAVING MULTIPLE RESONANT FREQUENCY BANDS AND WIRELESS TERMINALS INCORPORATING THE SAME

(75) Inventor: Howard E. Holshouser, Efland, NC (US)

(73) Assignee: Ericsson, Inc., Research Triangle Park, NC (US)

( * ) Notice: Subject to any disclaimer, the term of this patent is extended or adjusted under 35 U.S.C. 154(b) by 4 days.

(21) Appl. No.: 10/075,739

(22) Filed: Feb. 14, 2002

(65) Prior Publication Data

US 2003/0151555 A1 Aug. 14, 2003

(51) Int. Cl.[7] ..... H01Q 1/38; H01Q 1/24

(52) U.S. Cl. ..... 343/700 MS; 343/702; 343/846

(58) Field of Search ..... 343/700 MS, 702, 343/846, 848; H01Q 1/38, 1/24

(56) References Cited

U.S. PATENT DOCUMENTS 5,434,579 A 7/1995 Kagoshima
5,684,492 A 11/1997 Kagoshima
6,195,048 B1 2/2001 Chiba et al.
6,255,994 B1 * 7/2001 Saito ..... 343/700 MS
6,483,462 B2 * 11/2002 Weinberger ..... 343/700 MS

FOREIGN PATENT DOCUMENTS

EP 1052723 A2 11/2000 ..... H01Q/9/04

OTHER PUBLICATIONS

US Patent Application Publication No. US 2002/0135521 A1, "Multiband PIFA Antenna for Portable Devices", dated Sep. 26, 2002.
PCT International Search Report, International Applicaton No. PCT/US02/37310 dated Oct. 18, 2002.

* cited by examiner

*Primary Examiner*—Hoanganh Le
(74) *Attorney, Agent, or Firm*—Myers Bigel Sibley & Sajovec PA

(57) ABSTRACT

Antennas for a communications device and wireless terminals are provided. A conductive element is provided along with a ground assembly including a ground element coupled to the conductive element. The ground element has a first state and a second state. The first state provides a first resonant frequency band when the ground element is in a first relative position that is a first distance from the conductive element. The second state provides a second frequency band when the ground element is in a second relative position that is a second distance, different from the first distance, from the conductive element.

38 Claims, 5 Drawing Sheets

ANTENNAS HAVING MULTIPLE RESONANT FREQUENCY BANDS AND WIRELESS TERMINALS INCORPORATING THE SAME

BACKGROUND OF THE INVENTION

The present invention relates to the field of communications, and, more particularly, to antennas and wireless terminals incorporating the same.

Recently, the size of wireless terminals has been decreasing. Many contemporary wireless terminals are less than 11 centimeters in length. Thus, there is increasing interest in small antennas that can be utilized as internally mounted antennas for wireless terminals. Inverted-F antennas, for example, may be well suited for use within the confines of wireless terminals, particularly wireless terminals undergoing miniaturization. Typically, conventional inverted-F antennas include a conductive element that is maintained in a spaced apart relationship with a ground plane. Exemplary inverted-F antennas are described in U.S. Pat. Nos. 5,684,492 and 5,434,579, which are incorporated herein by reference in their entirety.

Furthermore, it may be desirable for a wireless terminal to operate within multiple frequency bands in order to utilize more than one communications system. For example, Global System for Mobile communication (GSM) is a digital mobile telephone system that typically operates at a low frequency band, such as between 880 MHz and 960 MHz. Digital Communications System (DCS) is a digital mobile telephone system that typically operates at high frequency bands, such as between 1710 MHz and 1880 MHz. The frequency bands allocated for mobile terminals in North America include 824–894 MHz for Advanced Mobile Phone Service (AMPS) and 1850–1990 MHz for Personal Communication Services (PCS). Accordingly, internal antennas are being provided for operation within multiple frequency bands.

Conventional approaches for providing multiple frequency bands utilize band switching. These approaches focus on switching in the antenna matching network or in the active portions of the antenna, i.e. the feed points of the antenna. The active portion of the antenna is typically a high current point, thus, losses in the switching devices may be considerable. Furthermore, antenna matching networks are often bandwidth limited.

SUMMARY OF THE INVENTION

Embodiments of the present invention provide antennas for communications devices and wireless terminals. A conductive element is provided along with a ground assembly including a ground element coupled to the conductive element. The ground element has a first state and a second state. The first state provides a first resonant frequency band when the ground element is in a first relative position that is a first distance from the conductive element. The second state provides a second frequency band when the ground element is in a second relative position that is a second distance, different from the first distance, from the conductive element.

In some embodiments of the present invention the ground element includes a first ground plane in the first relative position spaced apart from the conductive element and a second ground plane, distinct from the first ground plane, in the second relative position spaced apart from the conductive element. In the first state the first ground plane may be coupled to the conductive element and the second ground plane may not coupled to the conductive element and the first and second ground planes may both coupled to the conductive element in the second state. Alternatively, in the first state the first ground plane may be coupled to the conductive element and in the second state the second ground plane may not coupled to the conductive element and the second ground plane may be coupled to the conductive element and the first ground plane may not coupled to the conductive element.

In further embodiments of the present invention, a controller may be configured to select a system frequency band within at least one of the first resonant frequency band and/or the second resonant frequency band and to generate a system frequency band identifier signal based on the selected system frequency band. Alternatively, a user interface may receive a user input designating at least one of the first resonant frequency band and the second resonant frequency band. The ground assembly may further include a switch configured to couple at least one of the first ground plane and/or second ground plane to the conductive element responsive to the system frequency identifier signal and/or the user input. The switch may further be configured to decouple at least one of the first ground plane and/or second ground plane from the conductive element responsive to the system frequency identifier signal and/or the user input. The switch may include at least one of a MEMS switch, a PIN diode switch, an electronic switch and/or a mechanical switch.

In still further embodiments of the present invention, the ground element may include a single ground plane. The ground plane may be in the first relative position in the first state and the second relative position in the second state.

In some embodiments of the present invention, a controller configured to select a system frequency band within at least one of the first resonant frequency band and/or the second resonant frequency band and generate a system frequency band identifier signal based on the selected system frequency band. Alternatively, a user interface may receive a user input designating at least one of the first resonant frequency band and the second resonant frequency band. The ground assembly may further include a motion means for moving at least one of the ground plane and/or the conductive element responsive to the system frequency band identifier signal and/or the user input.

In further embodiments of the present invention, the first resonant frequency band may include at least one of 800 MHz, 900 MHz, 1800 MHz and/or 1900 MHz. The second resonant frequency band may include at least one different one of 800 MHz, 900 MHz, 1800 MHz and/or 1900 MHz. The conductive element may be a planar inverted-F antenna (PIFA) element.

DETAILED DESCRIPTION OF THE INVENTION

Figure 1:
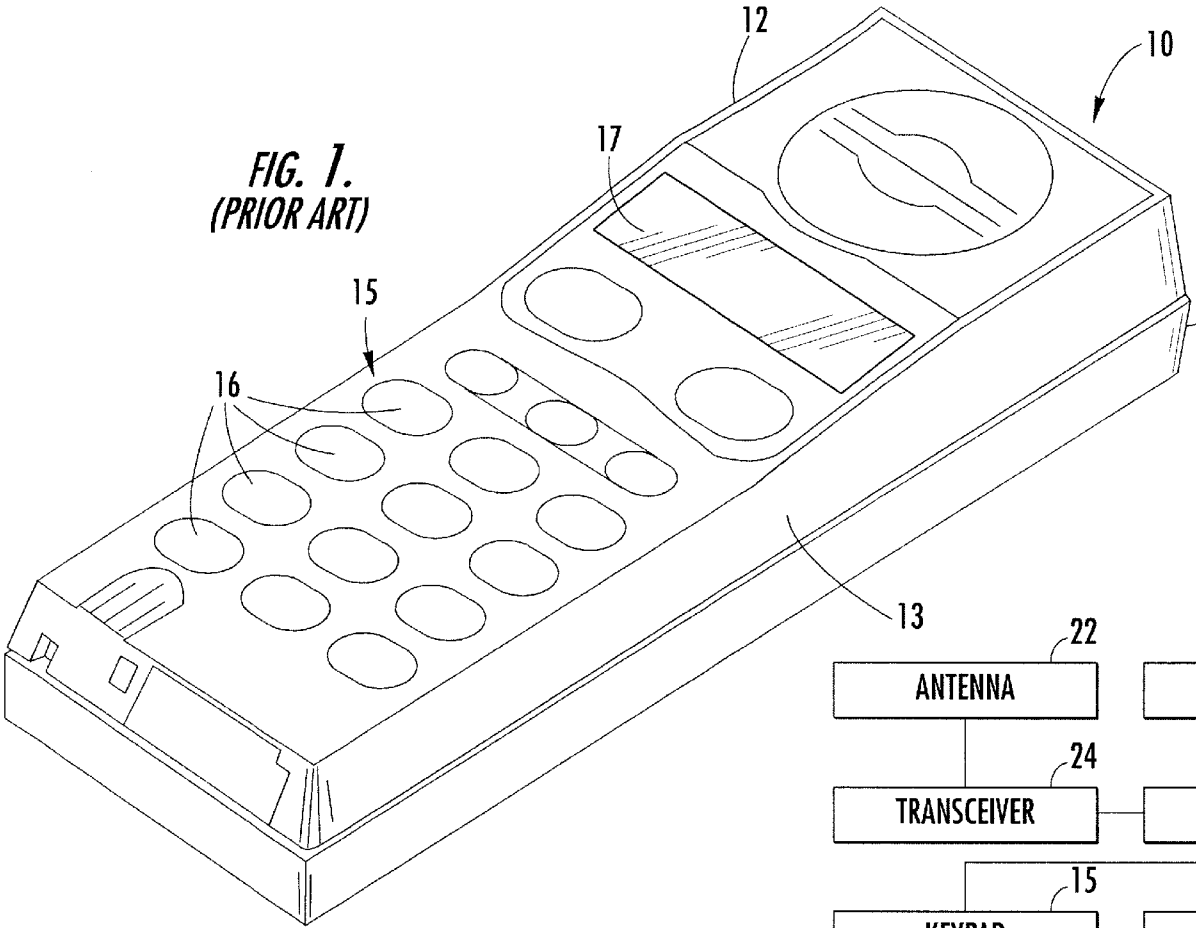
FIG. 1. (PRIOR ART)
FIG. 1 is a perspective view of a conventional wireless terminal.

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the thickness of lines, layers and regions may be exaggerated for clarity. It will be understood that when an element, such as a layer, region or substrate, is referred to as being "on" another element, it can be directly on the other element or intervening elements may also be present. In contrast, when an element is referred to as being "directly on" another element, there are no intervening elements present. It will also be understood that, when an element is referred to as being "connected" or "coupled" to another element, it can be directly connected to the other element or intervening elements may be present. In contrast, when an element is referred to as being "directly connected" or "directly coupled" to another element, there are no intervening elements present. Like numbers refer to like elements throughout.

Embodiments of the present invention will now be described in detail below with reference to FIGS. 1 through 7. According to embodiments of the present invention, antennas for communications devices have first and second states. The first state provides a first resonant frequency band when a ground element is in first relative position a first distance from the conductive element. The second state provides a second resonant frequency band when the ground element is in a second relative position a second distance, different from the first distance, from the conductive element. If an inverted-F conductive element is provided, the first state may provide first and second resonant frequency bands and the second state may provide third and fourth resonant frequency bands. Antennas according to embodiments of the present invention may be useful in, for example, multiple mode wireless terminals that support two or more different resonant frequency bands, such as world phones and/or dual mode phones.

Referring to FIG. 1, a conventional wireless terminal will now be discussed in further detail. As used herein, the term "wireless terminal" may include, but is not limited to, a cellular wireless terminal with or without a multi-line display; a Personal Communications System (PCS) terminal that may combine a cellular wireless terminal with data processing, facsimile and data communications capabilities; a PDA that can include a wireless terminal, pager, Internet/intranet access, Web browser, organizer, calendar and/or a global positioning system (GPS) receiver; and a conventional laptop and/or palmtop receiver or other appliance that includes a wireless terminal transceiver. Wireless terminals may also be referred to as "pervasive computing" devices and may be mobile terminals.

Antennas having a ground assembly according to embodiments of the present invention may be incorporated into a wireless terminal, for example, the wireless terminal 10 illustrated in FIG. 1. As illustrated, the wireless terminal 10 includes a housing 12. The housing 12 includes a top portion 13 and a bottom portion 14 connected to the top portion 13, thus forming a cavity therein. The top and bottom housing portions 13, 14 house a keypad 15, which may include a plurality of keys 16, a display 17, and electronic components (not shown) that enable the wireless terminal 10 to transmit and receive communications signals.

It will be understood that, although antennas according to embodiments of the present invention are described herein with respect to wireless terminals, embodiments of the present invention are not limited to such a configuration. For example, antennas according to embodiments of the present invention may be used within wireless communicators that may only transmit or only receive wireless communications signals. For example, conventional AM/FM radios or any receiver utilizing an antenna may only receive communications signals. Alternatively, remote data input devices may only transmit communications signals.

Figure 2:
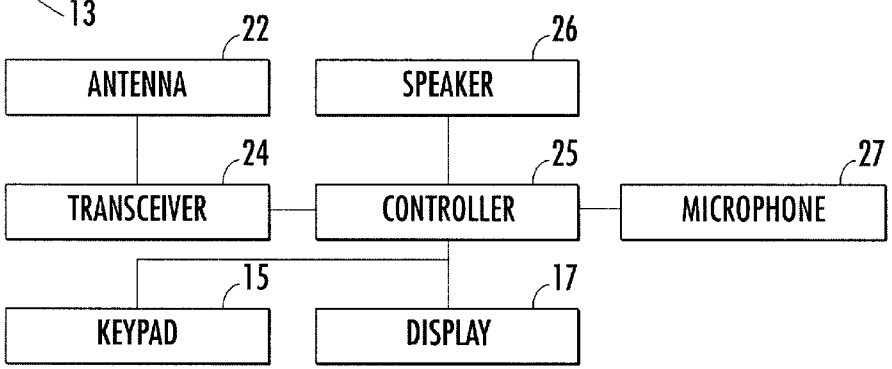
FIG. 2. (PRIOR ART)
FIG. 2 is a schematic block diagram of a conventional arrangement of electronic components within the wireless terminal of FIG. 1.

Referring now to FIG. 2, a conventional arrangement of electronic components that enable a wireless terminal to transmit and receive wireless terminal communication signals will be described in further detail. As illustrated, an antenna 22 for receiving and/or transmitting wireless terminal communication signals is electrically connected to a radio-frequency (RF) transceiver 24 that is further electrically connected to a controller 25, such as a microprocessor. The controller 25 is electrically connected to a speaker 26 that is configured to transmit a signal from the controller 25 to a user of a wireless terminal. The controller 25 is also electrically connected to a microphone 27 that receives a voice signal from a user and transmits the voice signal through the controller 25 and transceiver 24 to a remote device. The controller 25 is electrically connected to the keypad 15 and the display 17 that facilitate wireless terminal operation.

It will be understood by those having skill in the art of communications devices that an antenna is a device that may be used for transmitting and/or receiving electrical signals. During transmission, an antenna may accept energy from a transmission line and radiate this energy into space. During reception, an antenna may gather energy from an incident wave and provide this energy to a transmission line. The amount of power radiated from or received by an antenna is typically described in terms of gain.

Radiation patterns for antennas are often plotted using polar coordinates. Voltage Standing Wave Ratio (VSWR) relates to the impedance match of an antenna feed point with a feed line or transmission line of a communications device, such as a wireless terminal. To radiate radio frequency energy with minimum loss, or to pass along received RF energy to a wireless terminal receiver with minimum loss, the impedance of a wireless terminal antenna is conventionally matched to the impedance of a transmission line or feed point.

Conventional wireless terminals typically employ an antenna that is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to compensate for undesired antenna impedance components, to provide a 50-Ohm (Ω) (or desired) impedance value at the feed point.

Figure 3A:
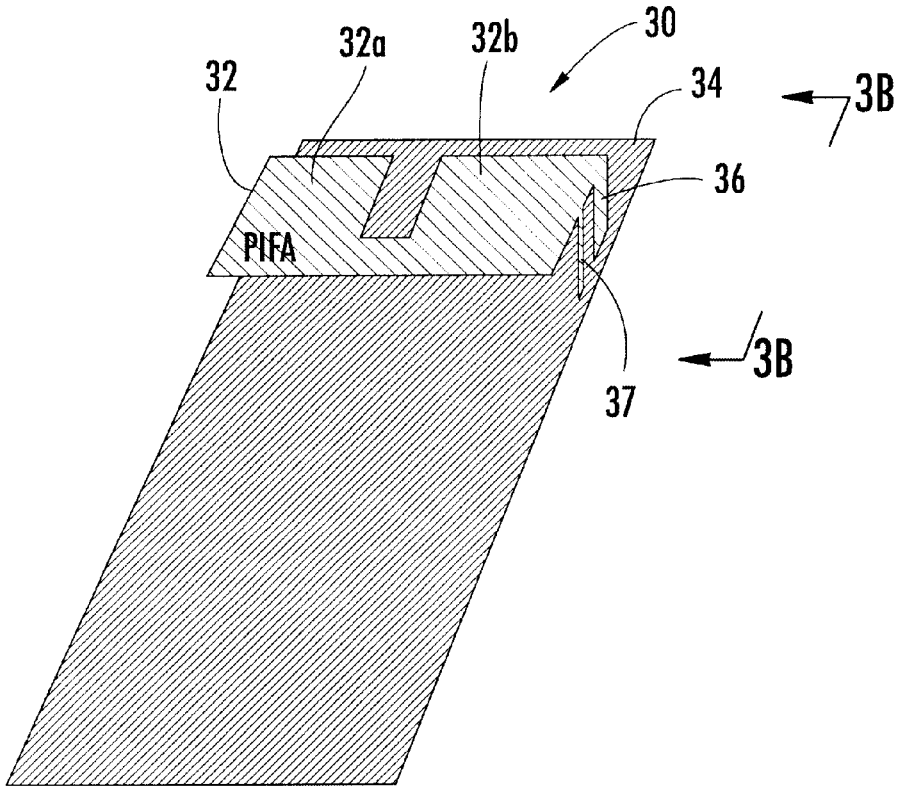
FIG. 3A. (PRIOR ART)
FIG. 3A is a perspective view of a conventional planar inverted-F antenna.
Figure 3B:
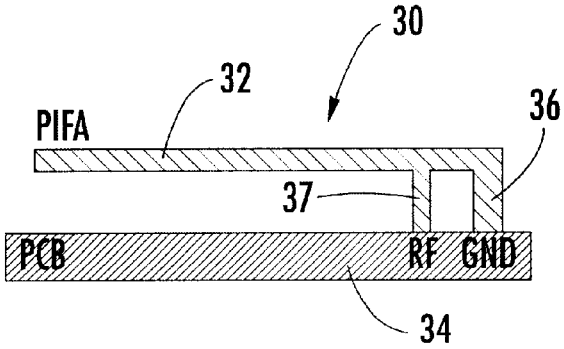
FIG. 3B. (PRIOR ART)
FIG. 3B is a side view of the conventional planar inverted-F antenna of FIG. 3A taken along the line 3B—3B.

Referring now to FIGS. 3A and 3B, a perspective view and a side view taken along lines 3B—3B in FIG. 3A of a conventional inverted-F antenna will be discussed. A conventional inverted-F antenna 30 may be configured for use in a wireless terminal, for example, the wireless terminal 10 illustrated in FIG. 1. Conventional inverted-F antennas derive their name from their resemblance to the letter "F." As illustrated, the antenna 30 includes a conductive element 32 maintained in spaced apart relationship with a ground plane 34. The illustrated conductive element 32 has first and second portions or branches 32*a,* 32*b,* which may be resonant in different respective frequency bands, as would be understood by those skilled in the art. The conductive element 32 is grounded to the ground plane 34 via a ground feed 36. A signal feed 37 extends from a signal receiver and/or transmitter (e.g., an RF transceiver) underlying or overlying the ground plane 34 to the conductive element 32, as would be understood by those of skill in the art.

Figure 4:
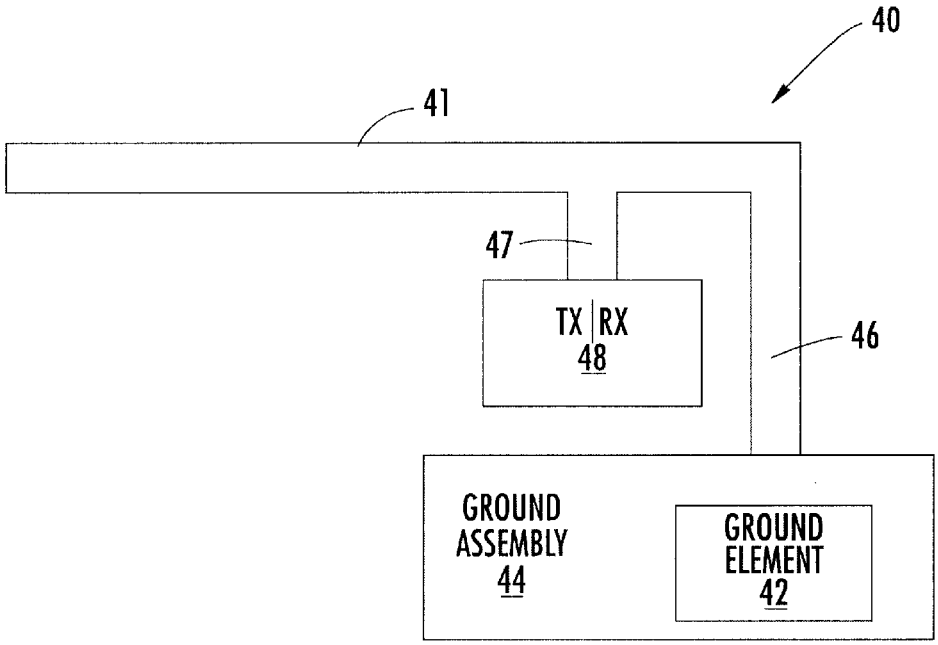
FIG. 4 is a schematic block diagram of antennas according to embodiments of the present invention.

Referring now to FIG. 4, an antenna having a ground assembly 44 according to embodiments of the present invention will be discussed. It will be understood that the antenna may be configured for use with various wireless communicators, such as wireless terminals as discussed above. As illustrated, an antenna 40 according to embodiments of the present invention includes a conductive element 41 that is configured to be mounted, for example, internally within a wireless communicator, such as a wireless terminal. The conductive element 41 may be, for example, an inverted-F conductive element or other microstrip antenna element.

As further illustrated in FIG. 4, antennas according to embodiments of the present invention also include a ground assembly 44 including a ground element 42 coupled to the conductive element 41. The ground element 42 has first and second states for use within antennas according to embodiments of the present invention. The first state may provide a first resonant frequency band and the second state may provide a second resonant frequency band. The first and second resonant frequency bands may be determined based on the spacing between the conductive element 41 and the ground element 42. Thus, the first state provides a first resonant frequency band when there is a first spacing between the conductive element 41 and the ground element 42, i.e. the ground element 42 is in a first relative position. Similarly, the second state provides a second resonant frequency band when there is a second spacing, different from the first spacing, between the conductive element 41 and the ground element 42, i.e. the ground element is in a second relative position.

It will be understood by those having skill in the art that the frequency bands within which antennas according to embodiments of the present invention resonate may be adjusted by changing the shape, length, width, spacing and/or state of one or more conductive elements of the antenna. As discussed above, for example, the resonant frequency bands may be changed by adjusting the spacing between the conductive element and the ground element. Antennas according to embodiments of the present invention may support the Global System for Mobile (GSM) communication frequency band, the Digital Communications System (DCS) frequency band, the Advanced Mobile Phone Service (AMPS) frequency band, and the Personal Communication Services (PCS) frequency band and/or combinations of the same. In other words, antennas according to embodiments of the present invention may support a frequency band from 880 MHz to about 960 MHz for GSM, from 1710 MHz to about 1880 MHz for DCS, from about 824 MHz to about 894 MHz for AMPS, and/or from about 1850 MHz to about 1990 MHz for PCS.

Referring again to FIG. 4, antennas according to embodiments of the present invention further include a signal feed 47 that is electrically connected to the conductive element 41 and extends outwardly from the conductive element 41 to electrically connect the antenna 40 to, for example, a wireless communications signal receiver and/or transmitter 48. A ground feed 46 also extends outwardly from the conductive element 41 adjacent the signal feed 47 and grounds the antenna 40, for example, via a ground plane, such as the ground plane 34 in FIGS. 3A and 3B.

Figure 5:
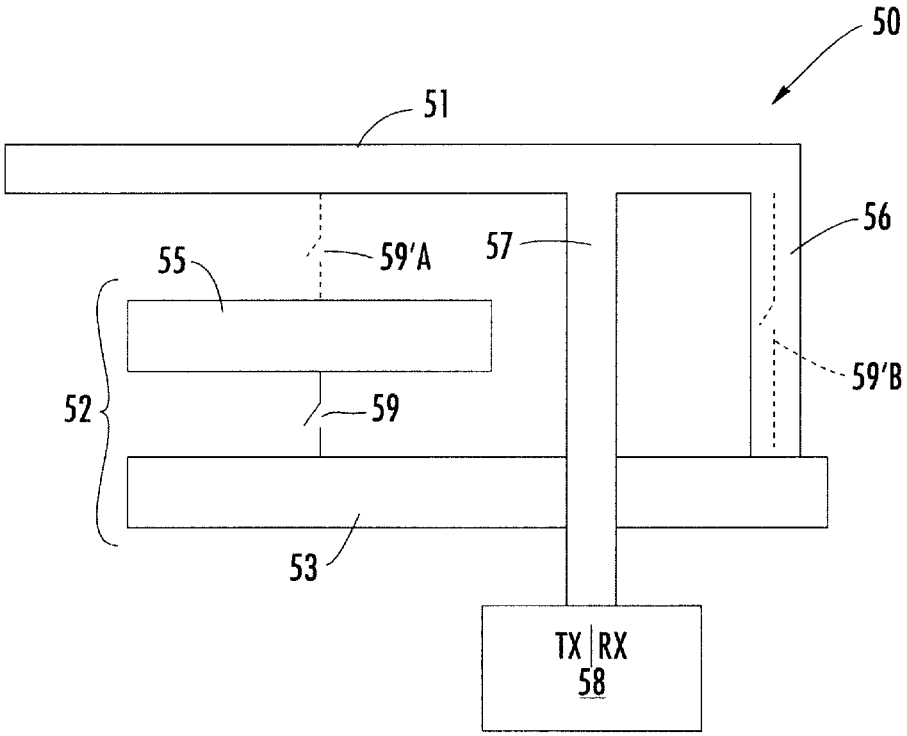
FIG. 5 is a side view of antennas according to embodiments of the present invention.

Referring now to FIG. 5, embodiments of the present invention having two ground planes will now be discussed in detail. As illustrated in FIG. 5, an antenna 50 according to embodiments of the present invention includes a conductive element 51, a signal feed 57, and a ground feed 56. The signal feed 57 is electrically connected to the conductive element 51 and extends outwardly from the conductive element 51 to electrically connect the antenna 50 to, for example, a wireless communications signal receiver and/or transmitter 58.

The antenna 50 further includes a ground assembly. The ground assembly of the antenna 50 includes a ground element 52 having a first ground plane 53 that is spaced apart from and coupled to the conductive element 51 and a second ground plane 55 that is separate from the first ground plane. According to embodiments of the present invention illustrated in FIG. 5, a first state of the antenna 50 is provided by the first ground plane 53 when the second (or switched ground plane as shown in FIG. 5) ground plane 55 is not electrically coupled the conductive element. Similarly, a second state of the antenna 50 is provided when the second ground plane 55 that is spaced apart from the conductive element 51 is electrically coupled to the conductive element 51. Accordingly, the first state provides a first resonant frequency band when the first ground plane 53 is electrically coupled to the conductive element 51 and the second ground plane 55 is not and the second state provides a second resonant frequency band when the first ground plane 53 and the second ground plane 55 are both electrically coupled to the conductive element 51. It will be understood that ground planes according to embodiments of the present invention, may have various shapes, configurations, and/or sizes and are not limited to the embodiments illustrated in the figures. It will be further understood that embodiments of the present invention are not limited to having two ground planes.

The ground assembly may further include, for example, a switch 59 that may be activated and/or deactivated so that the proper ground plane will be electrically connected to the conductive element 51 to provide the selected system frequency. As illustrated, the switch 59 may couple or decouple the second ground plane 55 to the first ground plane 53 and the conductive element 51. Alternatively, there may be two or more switches. For example, as further illustrated by the dotted line switches, a first switch 59A' may couple the second ground plane 55 to or decouple the second ground plane 55 from the conductive element 51. Similarly, a second switch 59B' may replace the ground feed 56 and may couple the first ground plane 53 to or decouple the first ground plane 53 from the conductive element 51. Thus, in this embodiment of the present invention only one ground plane is coupled to the conductive element at a time. Similarly, a single switch may selectively couple one of the ground planes while decoupling the other ground plane. The switch may be, for example, a MEMS switch, a PIN diode switch, an electronic switch, a mechanical switch or the like.

It will be understood that the above-described switching configurations are described for exemplary purposes only and the present invention should not be limited to the described configurations.

It will be understood that when, for example, the second ground plane is decoupled from the first ground plane and/or the conductive element, the presence of the second decoupled ground plane may still influence the first ground plane coupled to the conductive element. However, generally, the second decoupled ground plane should not influence the operation of the first ground plane unless, for example, the dimensions of the second ground plane are selected to cause the second ground plane to be resonant at the same frequency as the antenna itself. Otherwise, in practice, the presence of the second decoupled ground plane should have no more than a slight influence on the operation of the first ground plane coupled to the conductive element. It will be further understood that the same is true for the reverse situation, i.e. when the first ground plane is decoupled from the second ground plane and/or the conductive element and the second ground plane is coupled to the conductive element, the presence of the first decoupled ground plane may have a slight influence on the operation of the second ground plane.

A controller, for example, the controller 25 of FIG. 2, may be configured to determine the resonant frequency band of the system in which the wireless terminal is operating. The system frequency may be a frequency found within the first and second resonant frequency bands. The controller may generate a system frequency band identifier signal that indicates the state in which the antenna 50 should operate. The switch may be configured to couple the proper ground plane to the conductive element 51 in response to the system frequency band identifier signal. Alternatively, a user interface, for example, the keypad 15 of FIG. 2, may receive a user input designating the system frequency band, which will typically fall within the first resonant frequency band and/or the second resonant frequency band. In this embodiment, the switch may be configured to couple the proper ground plane to the conductive element 51 in response to the user input designating the system frequency band. It will be understood that the switch may be either of the switch configurations discussed above or other switch configuration that will provide the switch functionality according to embodiments of the present invention.

Figure 6A:
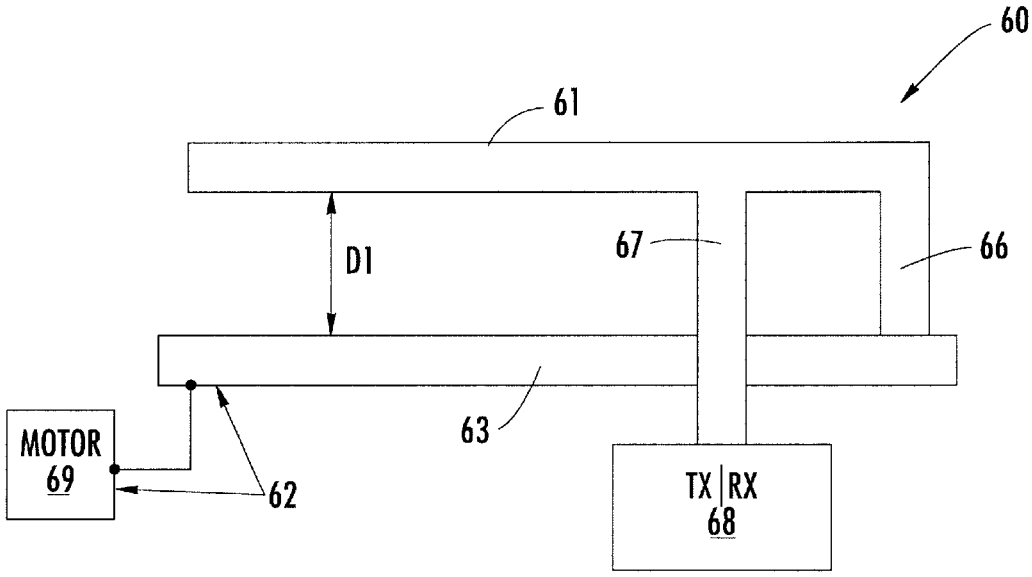
FIGS. 6A and 6B are side views of antennas according to further embodiments of the present invention.
Figure 6B:
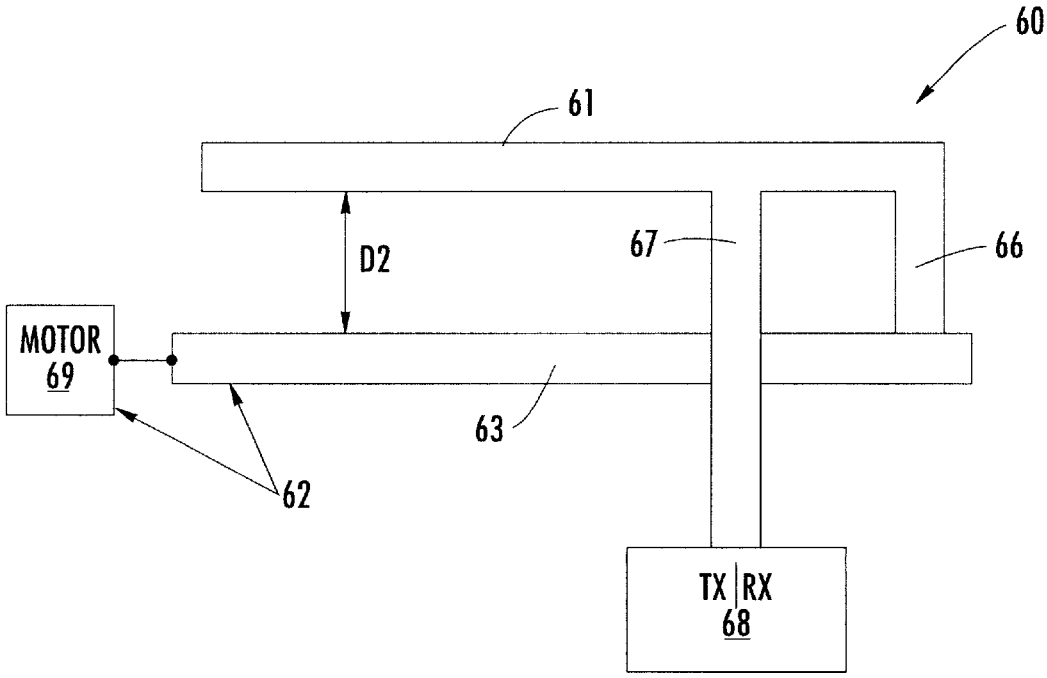

Referring now to FIGS. 6A and 6B, embodiments of the present invention having a movable ground plane will be discussed in detail. As illustrated in FIGS. 6A and 6B, an antenna 60 according to embodiments of the present invention includes a conductive element 61, a signal feed 67, and a ground feed 66 as discussed above. The signal feed 67 is electrically connected to the conductive element 61 and extends outwardly from the conductive element 61 to electrically connect the antenna 60 to, for example, a wireless communications signal receiver and/or transmitter 68.

The antenna 60 further includes a ground assembly. The ground assembly includes a ground element 62 having a single ground plane 63. The ground plane 63 has a first relative position with respect to the conductive element 61 and a second relative position with respect to the conductive element 61 that is distinct from the first relative position. According to embodiments of the present invention illustrated in FIGS. 6A and 6B, a first state of the antenna 60 is provided when the ground plane 63 is in the first relative position a first distance D1 from the conductive element 61. Similarly, a second state of the antenna 60 is provided when the ground plane 63 is in the second relative position a second distance D2, distinct from the first distance D1, from the conductive element 61. Accordingly, the first state provides a first resonant frequency band when the ground plane 63 is in a first relative position and the second state provides a second resonant frequency band when the ground plane 63 is in a second relative position. It will be understood that although two relative positions are discussed herein, the present invention should not be limited to this configuration. For example, the ground plane may have two or more relative positions with respect to the conductive element and still provide the functionality of embodiments of the present invention.

The ground assembly may further include, for example, a motor 69 or other motion means for moving at least one of the ground plane 63 and/or the conductive element 61 responsive to a system frequency band identifier signal generated as discussed below. The motion means may be provided by any means known to those of skill in the art that will also provide the desired movement of the ground plane. For example, the motion means may be a motor drive, a magnetic flapper, a solenoid, an electrostatically driven flapper, or the like.

A controller, for example, the controller 25 of FIG. 2, may be configured to determine the resonant frequency band of the system in which the wireless terminal is operating. The system frequency may be a frequency found within the first and second resonant frequency bands. The controller may generate a system frequency band identifier signal that indicates the state in which the antenna 50 should operate. The motor 69 or motion means may be configured to move the ground plane to the proper position in response to the system frequency band identifier signal. Alternatively, a user interface, for example, the keypad 15 of FIG. 2, may receive a user input designating the system frequency band, which will typically fall within the first resonant frequency band and/or the second resonant frequency band. In this embodiment, the motor 69 or other motion means may be configured to move the ground plane to the proper position in response to the user input.

As discussed above, the conductive element of FIGS. 5 and 6 may be an inverted-F conductive element as shown in FIG. 3. An inverted-F conductive element may have first and second branches as shown in FIG. 3 (32*a*, 32*b*). Thus, the first branch may be resonant within a first frequency band and the second branch may be resonant within a second frequency band different from the first frequency band. The first frequency band may be a low frequency band and the second frequency band may be a high frequency band, or vice-versa, as would be understood by those of skill in the art. For example, a frequency band of one of the branches may be between 824 MHz and 960 MHz (i.e., a low frequency band) and a frequency band of the other one of the branches may be between 1710 MHz and 1990 MHz (i.e., a high frequency band).

Accordingly, if an inverted-F conductive element is used in conjunction with a ground assembly according to embodiments of the present invention, a single antenna may provide four or more resonant frequency bands. For example, the first state may provide first and second resonant frequency bands in the first and second branches of the inverted-F conductive element, respectively. Similarly, the second state may provide third and fourth resonant frequency bands in the first and second branches of the inverted-F conductive element, respectively.

It will be understood by those of skill in the art that an inverted-F conductive element, according to embodiments of the present invention, may be formed on a dielectric substrate, for example, FR4 or polyimide, by etching a metal layer or layers in a pattern on the dielectric substrate. Furthermore, an inverted-F conductive element, according to embodiments of the present invention, may have any number of branches disposed on and/or within a dielectric substrate.

A conductive material out of which the illustrated inverted-F conductive element may be formed is copper. For example, the conductive element branches may be formed from copper sheet. Alternatively, the conductive element branches may be formed from a copper layer on a dielectric substrate. However, conductive element branches for inverted-F conductive elements according to the present invention may be formed from various conductive materials and are not limited to copper.

An inverted-F conductive element that may be utilized in an antenna according to embodiments of the present invention may have various shapes, configurations, and/or sizes. Embodiments of the present invention are not limited to the illustrated configuration of the inverted-F conductive element. For example, the present invention may be implemented with any micro-strip antenna. Moreover, embodiments of the present invention are not limited to inverted-F conductive elements having two branches. Inverted-F conductive elements utilized in embodiments of the present invention may have one or more radiating portions or branches.

It will be understood that although the term "ground plane" is used throughout the application, the term "ground plane", as used herein, is not limited to the form of a plane. For example, the "ground plane" may be a strip or any shape or reasonable size that does not resonate at the same frequency as the antenna itself.

Figure 7:
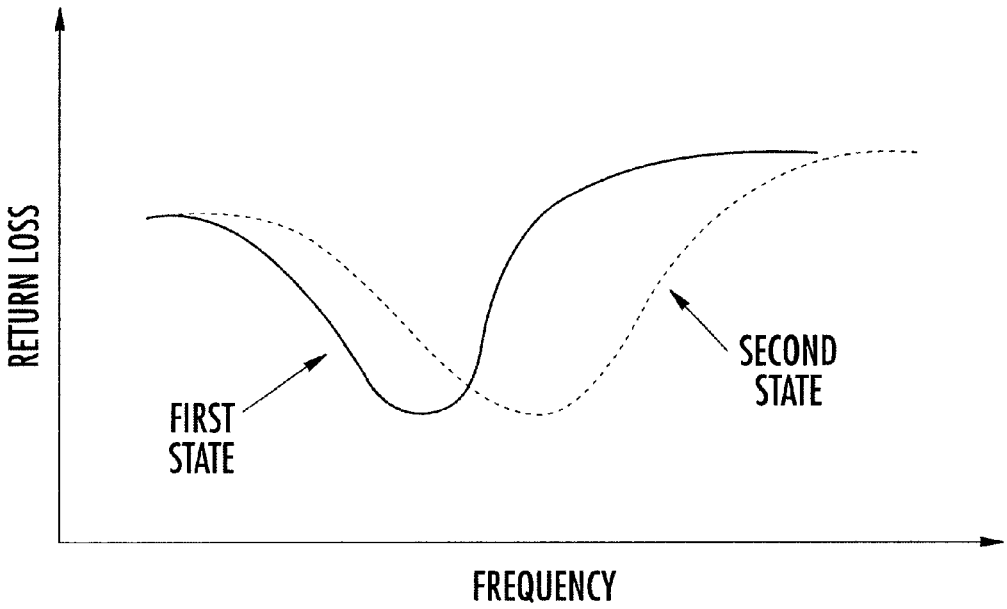
FIG. 7 is a graph illustrating a change in a resonant frequency band according to embodiments of the present invention.

Referring now to FIG. 7, a graph illustrating a change in a resonant frequency band from the first state to the second state in an antenna according to embodiments of the present invention will be discussed. As discussed above, the frequency bands within antennas according to embodiments of the present invention may be adjusted by changing the shape, length, width, spacing and/or state of one or more conductive elements of the antenna. As discussed above, for example, the resonant frequency bands may be changed by adjusting the spacing between the conductive element and the ground element. The spacing between the conductive element and the ground element may be adjusted by having two or more ground planes, each a different distance from the conductive element and thus, providing a different resonant frequency band corresponding to the different distances. Alternatively, the spacing may be adjusted by physically moving a single ground plane from one position to another using a motor or some other motion means within the ground assembly. Thus, an antenna having different states may be provided. A typical return loss versus frequency response for the first and second states of an antenna according to embodiments of the present invention is illustrated in FIG. 7.

As described above, antennas according to embodiments of the present invention provide first and second states. According to embodiments of the present invention, antennas for communications devices have first and second states. The first state provides a first resonant frequency band when a ground element is in first relative position a first distance from the conductive element. The second state provides a second resonant frequency band when the ground element is in a second relative position a second distance, different from the first distance, from the conductive element. Antennas according to embodiments of the present invention may be useful in, for example, multiple mode wireless terminals that support two or more different resonant frequency bands, such as world phones and/or dual mode phones.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. An antenna for a communications device, comprising:

a conductive element; and a ground assembly including a ground element coupled to the conductive element, and configured to transition between a first state and a second state, the first state providing a first resonant frequency band by providing the ground element at a first relative position a first distance from the conductive element and the second state providing a second frequency band by providing the ground element at a second relative position a second distance, different from the first distance, from the conductive element.

2. An antenna according to claim 1, wherein the ground element comprises a first ground plane in a first relative position spaced apart from the conductive element and a second ground plane, distinct from the first ground plane, in a second relative position spaced apart from the conductive element.

3. An antenna according to claim 2, wherein in the first state the first ground plane is coupled to the conductive element and the second ground plane is not coupled to the conductive element and wherein the first and second ground planes are both coupled to the conductive element in the second state.

4. An antenna according to claim 2, wherein in the first state the first ground plane is coupled to the conductive element and the second ground plane is not coupled to the conductive element and wherein in the second state the second ground plane is coupled to the conductive element and the first ground plane is not coupled to the conductive element.

5. An antenna according to claim 2, further comprising:

a controller configured to select a system frequency band within at least one of the first resonant frequency band and/or the second resonant frequency band and to generate a system frequency band identifier signal based on the selected system frequency band;

wherein the ground assembly further comprises a switch configured to couple at least one of the first ground plane and/or second ground plane to the conductive element responsive to the system frequency identifier signal in the first state and decouple at least one of the first ground plane and/or second ground plane from the conductive element responsive to the system frequency identifier signal in the second state.

6. An antenna according to claim 5, wherein the switch comprises at least one of a MEMS switch, a PIN diode switch, an electronic switch and/or a mechanical switch.

7. An antenna according to claim 2, further comprising:

a user interface that receives a user input designating at least one of the first resonant frequency band and the second resonant frequency band;

wherein the ground assembly further comprises a switch configured to couple at least one of the first ground plane and/or second ground plane to the conductive element responsive to the user input signal in the first state and decouple at least one of the first ground plane and/or second ground plane from the conductive element responsive to the user input in the second state.

8. An antenna according to claim 1, wherein the ground element further comprises a ground plane, wherein the ground plane is in the first relative position in the first state and wherein the ground plane is in the second relative position in the second state.

9. An antenna according to claim 8, wherein the ground plane moves between the first relative position to the second relative position and the conductive element remains stationary.

10. An antenna according to claim 8, further comprising:

a controller configured to select a system frequency band within at least one of the first resonant frequency band and/or the second resonant frequency band and generate a system frequency band identifier signal based on the selected system frequency band;

wherein the ground assembly further comprises a motion means for moving at least one of the ground plane and/or the conductive element responsive to the system frequency band identifier signal.

11. An antenna according to claim 8, further comprising:

a user interface that receives a user input designating at least one of the first resonant frequency band and the second resonant frequency band;

wherein the ground assembly further comprises a motion means for moving the ground plane between the first relative position and the second relative position responsive to the user input.

12. An antenna according to claim 1, wherein the first resonant frequency band comprises at least one of 800 MHz, 900 MHz, 1800 MHz and/or 1900 MHz; and wherein the second resonant frequency band comprises at least one different one of 800 MHz, 900 MHz, 1800 MHz and/or 1900 MHz.

13. An antenna according to claim 1, wherein the conductive element is a planar inverted-F antenna (PIFA) element.

14. An antenna for a communications device, comprising:

an inverted-F conductive element comprising first and second branches;

a ground assembly including a ground element coupled to the inverted-F conductive element and operative to transition between a first state and a second state, the first state providing a first resonant frequency band based on the first branch of the inverted-F conductive element and a second resonant frequency band based on the second branch of the inverted-F conductive element by providing the ground element at a first relative position a first distance from the inverted-F conductive element and the second state providing a third resonant frequency band based on the first branch of the inverted-F conductive element and a fourth resonant frequency band based on the second branch of the inverted-F conductive element by providing the ground element at a second relative position a second distance, different from the first distance, from the inverted-F conductive element.

15. An antenna according to claim 14, wherein the ground element comprises a first ground plane in a first relative position spaced apart from the conductive element and a second ground plane, distinct from the first ground plane, in a second relative position spaced apart from the conductive element.

16. An antenna according to claim 15, wherein in the first state the first ground plane is coupled to the inverted-F conductive element and the second ground plane is not coupled to the inverted-F conductive element and wherein the first and second ground planes are both coupled to the inverted-F conductive element in the second state.

17. An antenna according to claim 15, wherein in the first state the first ground plane is coupled to the inverted-F conductive element and the second ground plane is not coupled to the inverted-F conductive element and wherein in the second state the second ground plane is coupled to the inverted-F conductive element and the first ground plane is not coupled to the inverted-F conductive element.

18. An antenna according to claim 15, further comprising:

a controller configured to select a system frequency band within at least one of the first resonant frequency band, the second resonant frequency band, the third resonant frequency band and/or the fourth resonant frequency band and produce a system frequency band identifier signal based on the selected system frequency band;

wherein the ground assembly further comprises a switch configured to couple at least one of the first ground plane and/or second ground plane to the conductive element responsive to the system frequency identifier signal in the first state and decouple at least one of the first ground plane and/or second ground plane from the conductive element responsive to the system frequency identifier signal in the second state.

19. An antenna according to claim 18, wherein the switch comprises at least one of a MEMS switch, a PIN diode switch, an electronic switch and/or a mechanical switch.

20. An antenna according to claim 15, further comprising:

a user interface that receives a user input designating at least one of the first resonant frequency band, the second resonant frequency band, the third resonant frequency band and/or the fourth resonant frequency band based on the user input;

wherein the ground assembly further comprises a switch configured to couple at least one of the first ground plane and/or second ground plane to the conductive element responsive to the user input signal in the first state and decouple at least one of the first ground plane and/or second ground plane from the conductive element responsive to the user input in the second state.

21. An antenna according to claim 14, wherein the ground element further comprises a ground plane, wherein the ground plane is in the first relative position in the first state, and wherein the ground plane is in the second relative position in the second state.

22. An antenna according to claim 21, wherein the ground plane moves between the first relative position to the second relative position and the conductive element remains stationary.

23. An antenna according to claim 21, further comprising:

a controller for determining a system frequency band within at least one of the first resonant frequency band, the second resonant frequency band, the third resonant frequency band and/or the fourth resonant frequency band and producing a system frequency band identifier signal based on the system frequency band;

wherein the ground assembly further comprises a motion means for moving at least one of the ground plane and/or the conductive element responsive to the system frequency band identifier signal.

24. An antenna according to claim 21, further comprising:

a user interface that receives a user input designating at least one of the first resonant frequency band, the second resonant frequency band, the third resonant frequency band and/or the fourth resonant frequency band based on the user input;

wherein the ground assembly further comprises a motion means for moving the ground plane between the first relative position and the second relative position responsive to the user input.

25. An antenna according to claim 14, wherein the first resonant frequency band comprises at least one of 800 MHz, 900 MHz, 1800 MHz and 1900 MHz; wherein the second resonant frequency band comprises at least one of 800 MHz, 900 MHz, 1800 MHz and 1900 MHz; wherein the third resonant frequency band comprises at least one of 800 MHz, 900 MHz, 1800 MHz and 1900 MHz; and wherein the fourth resonant frequency band comprises at least one of 800 MHz, 900 MHz, 1800 MHz and 1900 MHz.

26. A wireless terminal, comprising:

a housing;

a receiver that receives wireless communications signals and/or a transmitter that transmits wireless communications signals positioned within the housing;

a conductive element within the housing coupled to the receiver and/or transmitter; and a ground assembly including a ground element coupled to the conductive element, and configured to transition between a first state and a second state, the first state providing a first resonant frequency band by providing the ground element at a first relative position a first distance from the conductive element and the second state providing a second frequency band by providing the ground element at a second relative position a second distance, different from the first distance, from the conductive element.

27. A wireless terminal according to claim 26, wherein the ground element comprises a first ground plane in the first relative position spaced apart from the conductive element and a second ground plane, distinct from the first ground plane, in the second relative position spaced apart from the conductive element.

28. A wireless terminal according to claim 27, wherein in the first state the first ground plane is coupled to the conductive element and the second ground plane is not coupled to the conductive element and wherein the first and second ground planes are both coupled to the conductive element in the second state.

29. A wireless terminal according to claim 27, wherein in the first state the first ground plane is coupled to the conductive element and the second ground plane is not coupled to the conductive element and wherein in the second state the second ground plane is coupled to the conductive element and the first ground plane is not coupled to the conductive element.

30. A wireless terminal according to claim 27, further comprising:

a controller configured to select a system frequency band within at least one of the first resonant frequency band and/or the second resonant frequency band and to produce a system frequency band identifier signal based on the selected system frequency band;

wherein the ground assembly further comprises a switch configured to couple at least one of the first ground plane and/or second ground plane to the conductive element responsive to the system frequency identifier signal in the first state and decouple at least one of the first ground plane and/or second ground plane from the conductive element responsive to the system frequency identifier signal in the second state.

31. A wireless terminal according to claim 30, wherein the switch comprises at least one of a MEMS switch, a PIN diode switch, an electronic switch and/or a mechanical switch.

32. A wireless terminal according to claim 27, further comprising:

a user interface that receives a user input designating at least one of the first resonant frequency band, the second resonant frequency band, the third resonant frequency band and/or the fourth resonant frequency band;

wherein the ground assembly further comprises a switch configured to couple at least one of the first ground plane and/or second ground plane to the conductive element responsive to the user input signal in the first state and decouple at least one of the first ground plane and/or second ground plane from the conductive element responsive to the user input in the second state.

33. A wireless terminal according to claim 26, wherein the ground element further comprises a ground plane, wherein the ground plane is in the first relative position in the first state, and wherein the ground plane is in the second relative position in the second state.

34. A wireless terminal according to claim 33, wherein the ground plane moves between the first relative position to the second relative position and the conductive element remains stationary.

35. A wireless terminal according to claim 33, further comprising:

a controller for selecting a system frequency band within at least one of the first resonant frequency band and/or the second resonant frequency band and producing a system frequency band identifier signal based on the selected system frequency band;

wherein the ground assembly further comprises a motion means for moving the ground plane between the first relative position and the second relative position responsive to the system frequency band identifier signal.

36. A wireless terminal according to claim 33, further comprising:

a user interface that receives a user input designating at least one of the first resonant frequency band and the second resonant frequency band;

wherein the ground assembly further comprises a motion means for moving at least one of the ground plane and/or the conductive element responsive to the user input.

37. A wireless terminal according to claim 26, wherein the first resonant frequency band comprises at least one of 800 MHz, 900 MHz, 1800 MHz and/or 1900 MHz; and wherein the second resonant frequency band comprises at least one of 800 MHz, 900 MHz, 1800 MHz and/or 1900 MHz.

38. A wireless terminal according to claim 26, wherein the conductive element is a planar inverted-F antenna (PIFA) element.

* * * * *